United States Patent [19]

Knight

[11] 4,012,988

[45] Mar. 22, 1977

[54] MECHANICAL FLY-AWAY LATCHING MECHANISM

[75] Inventor: Frederick W. Knight, Orlando, Fla.

[73] Assignee: The United States of America as represented by the Secretary of the Army, Washington, D.C.

[22] Filed: June 7, 1976

[21] Appl. No.: 693,254

[52] U.S. Cl. ..... 89/1.806; 403/322

[51] Int. Cl.[2] ..... F41F 3/04

[58] Field of Search ..... 89/1.806, 1.812, 1.807, 89/1.8; 403/322, 321, 315, 316, 317

[56] References Cited

UNITED STATES PATENTS

| | | | |
|---|---|---|---|
| 2,851,287 | 9/1958 | Tangard | 403/322 X |
| 3,038,383 | 6/1962 | Tiesenhausen | 89/1.806 |
| 3,076,385 | 2/1963 | Bornhoft | 89/1.806 |
| 3,186,302 | 6/1965 | Price | 89/1.806 |
| 3,187,631 | 6/1965 | Cromwell et al. | 89/1.806 |
| 3,296,929 | 1/1967 | Jacobson | 89/1.806 |

*Primary Examiner*—David H. Brown
*Attorney, Agent, or Firm*—Nathan Edelberg; Robert P. Gibson; Charles R. Carter

[57] ABSTRACT

A mechanical latching mechanism for releasably securing a missile from movement prior to launching. The mechanism includes a control rod for actuating a laterally movable slide bar. Withdrawal of the bar allows the restraint pin to pivot forwardly and downwardly upon movement of the missile, thus withdrawing the tip of the pin from the missile.

3 Claims, 2 Drawing Figures

MECHANICAL FLY-AWAY LATCHING MECHANISM

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

This invention relates to missile latching mechanisms. Previous missile latch mechanisms involved an explosive device to pull the pin out to a position when a shear plane was exposed. After ignition, the missile thrust sheared away that portion of the pin allowing the missile to be launched.

SUMMARY OF THE INVENTION

The present invention has provided an improvement which provides a reusable restraining means for the missile. Prior to launching the missile is elevated in varying degrees to a maximum of 38° and restraint is needed to prevent the missile from sliding backwards. In addition this invention has a provision in case of a decision not to launch that the slide bar can be moved back and restraint is reinstated.

This invention can be better understood from the following detailed description taken in conjunction with the accompanying drawing.

DESCRIPTION OF THE PREFERRED EMBODIMENT

Figure 2:
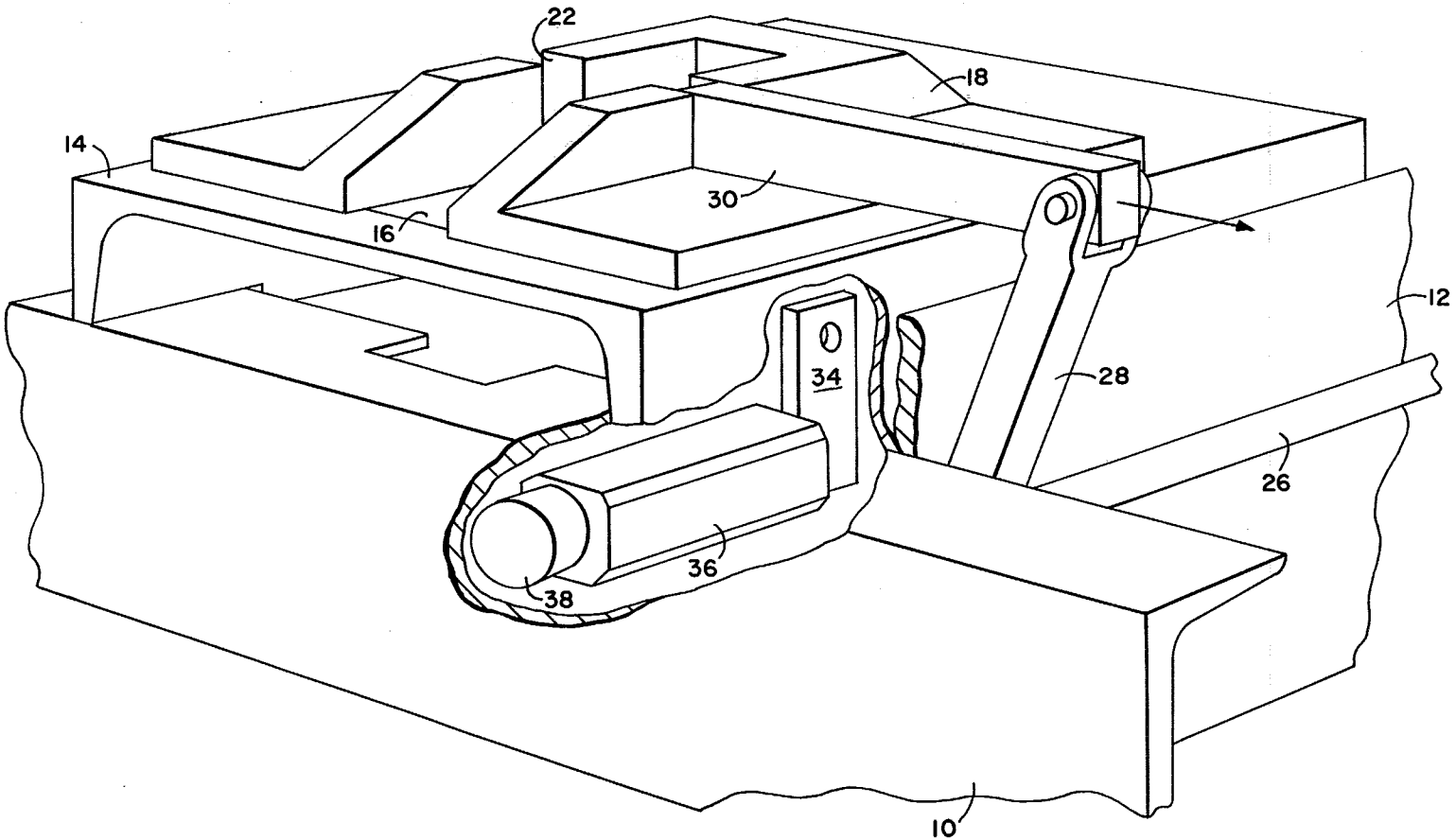
FIG. 2 is a pictoral view of the mechanism in the unlatched position.

Reference numerals 10 and 12 represent support elements of the missile launcher. A plate 14 having an opening 16 supports a bracket 18 provided with a slot 20 that is positioned over opening 16. The bracket 18 is further provided with a cross slot 22, more clearly shown in FIG. 2.

Figure 1:
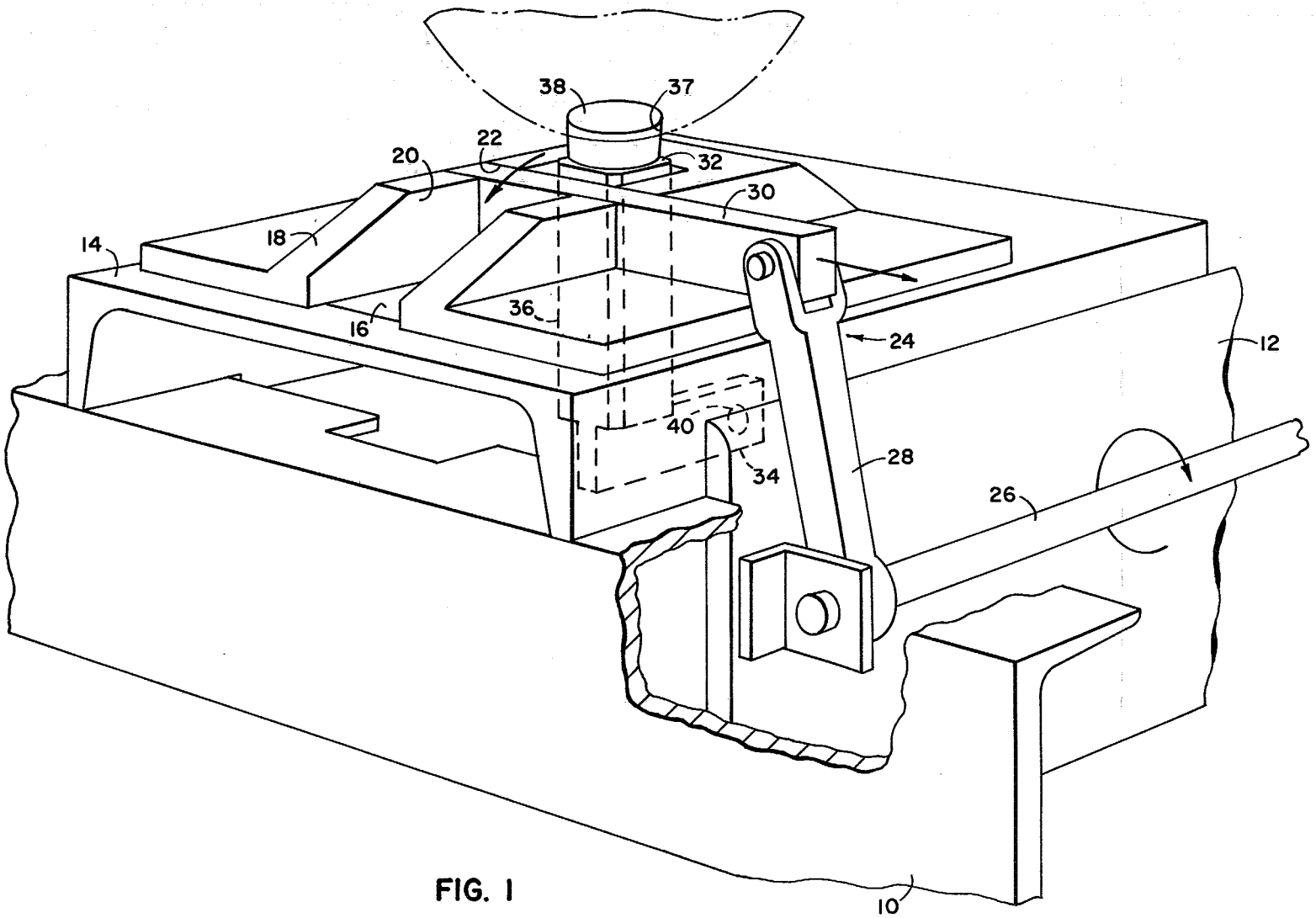
FIG. 1 is a pictoral view of the mechanism in the secured position.

A latch assembly generally indicated as 24 includes a control rod 26 connected to one end of an operating crank 28. The opposite end of crank 28 is pivotably connected to a bar 30 which slides in cross slot 22 when actuated by rod 26. An L-shape restraint pin 32 is pivotably connected to the support structure at one leg 34 of the pin. The other leg 36 of the pin 32 has circular shaped outer end 38 to engage a socket 37 located on the forward motor skirt of the missile to thereby restrain movement of the missile when in the position shown in FIG. 1. Leg 36 is located away from the pivot 40 so that when bar 30 is removed the pin will freely pivot about 40 due to the inertia of leg 36 responsive to missile movement.

In operation, the forward direction of a missile is restrained for handling and transportation purposes by the bar 30. After the launcher is elevated and prior to firing, the control rod 26 operates to mechanically slide the bar out of the way to the position shown in FIG. 2. When the missile moves forward after ignition the pin 32 freely pivots and drops out of the socket thus unlatching the missile.

I claim:

1. A latching mechanism for releasably engaging a missile socket to prevent missile movement against transportation and handling loads comprising: a freely pivoted L-shaped restraint pin, said pin being provided with a circular end for engaging the missile socket; a slidable bar for holding said restraint pin in its engaged position and means for controlling movement of said bar to a disengaged position whereby said restraint pin can pivot out of said socket responsive to ignition of the missile motor.

2. A latching mechanism as set forth in claim 1 wherein said control means includes a rod and a crank connected to said rod and to said slide bar.

3. A latching mechanism as set forth in claim 2 wherein said L-shaped restraint pin includes a pivot leg and an engaging leg disposed from said pivot leg whereby the inertia of the engaging leg will overcome the inertia of the pivot leg to cause rotation about a pivot point responsive to the missile movement.

* * * * *